United States Patent [19]

Werjefelt

[11] Patent Number: 4,998,529

[45] Date of Patent: Mar. 12, 1991

[54] DECOMPRESSION AND TOXIC FUME PROTECTION APPARATUS

[75] Inventor: Bertil Werjefelt, Kailua, Hi.

[73] Assignees: Xenex Corporation; Xenex Systems Limited Partnership I, both of Kaneohe, Hi.

[21] Appl. No.: 497,241

[22] Filed: Sep. 27, 1989

Related U.S. Application Data

[63] Continuation-in-part of Ser. No. 11,653, Apr. 27, 1988, abandoned.

[51] Int. Cl.[5] ..... A62B 18/08

[52] U.S. Cl. ..... 128/201.13; 128/201.25; 128/201.28; 128/205.28

[58] Field of Search ..... 128/200.14, 201.13, 128/201.22, 201.24, 201.25, 201.28, 201.29, 202.11–202.13, 204.18, 205.12, 205.13, 205.17, 205.25, 205.26, 205.22, 205.28, 206.17, 206.27, 911; 2/5, 6, 7, 171, 171.4, 173, 202, 205, 204.1, 204.2, 424, DIG. 3

[56] References Cited

U.S. PATENT DOCUMENTS

| | | | |
|---|---|---|---|
| 629,833 | 8/1899 | Wanz et al. | 128/201.25 |
| 996,739 | 7/1911 | Vinton | 128/201.13 |
| 2,048,059 | 7/1936 | Boudemange | 128/201.25 |
| 2,850,011 | 4/1958 | Schaefer | 128/201.28 |
| 3,710,791 | 1/1973 | Deaton | 128/205.26 |
| 3,906,945 | 9/1975 | Netteland et al. | 128/205.28 |
| 3,911,913 | 10/1975 | June | 128/201.29 |
| 3,913,576 | 10/1975 | Martin et al. | 128/204.25 |
| 4,087,088 | 11/1977 | Kovacevic | 128/201.23 |
| 4,236,514 | 12/1980 | Moretti | 128/201.23 |
| 4,269,183 | 5/1981 | Hunt | 128/201.13 |

*Primary Examiner*—Randall L. Green
*Assistant Examiner*—K. M. Reichle
*Attorney, Agent, or Firm*—Shlesinger & Myers

[57] ABSTRACT

Decompression and toxic fume protection apparatus comprising an inner chamber adapted to surround the head of the wearer, an inflatable and concentric outer chamber, a gas reservoir, means for removal of carbon dioxide and passageways for the circulation of gas through the apparatus.

7 Claims, 4 Drawing Sheets

DECOMPRESSION AND TOXIC FUME PROTECTION APPARATUS

CROSS-REFERENCE TO RELATED APPLICATION

This application is a continuation-in-part of application Ser. No. 07/011,653 filed Apr. 27, 1987, now abandoned.

BACKGROUND OF THE INVENTION

A continuing concern for the aircraft industry is apparatus for the protection of passengers against either decompression in flight or toxic fumes resulting from on-board fires. Previously, oxygen masks and other apparatus have been provided for passenger use. However, previous apparatus do not satisfy the need for individual smoke protection of 20 minutes or more, and the size and weight of apparatus previously available has limited its use in aircraft. Typically the ratio of equipment poundage to minutes of protection was on the order of 1:0.5 to 1:3. In addition, much of the equipment previously available for decompression or toxic fume protection is complicated to use and might be of limited value to an aircraft passenger in an emergency situation. Accordingly, a continuing need exists for an uncomplicated, light-weight apparatus that will provide extended protection against toxic fumes in an aircraft environment. Similarly, a need exists for such an apparatus in a variety of other applications such as hotels and hospitals in which it may be necessary to escape from a smoke-filled environment with an apparatus that provides at least about 20 minutes of breathable air for the user.

SUMMARY OF THE INVENTION

The present invention provides an improved apparatus for protection against decompression and toxic fumes, particularly in an aircraft environment, which permits more complete utilization of available oxygen.

Specifically, the instant invention provides a breathing device having an inner chamber and an inflatable outer chamber concentric with and surrounding the inner chamber, the inner and outer chambers being adapted to surround the head of a wearer;

a gas reservoir;

a gas inlet leading to the outer chamber and a valve permitting gas to flow from the outer chamber to the reservoir; and a passageway to permit gas to flow between the reservoir and the inner chamber through a $CO_2$ removal means, the outer chamber being inflatable to a rigidity sufficient to maintain substantially constant volume of the inner chamber while the wearer is breathing.

DETAILED DESCRIPTION OF THE INVENTION

Figure 1:
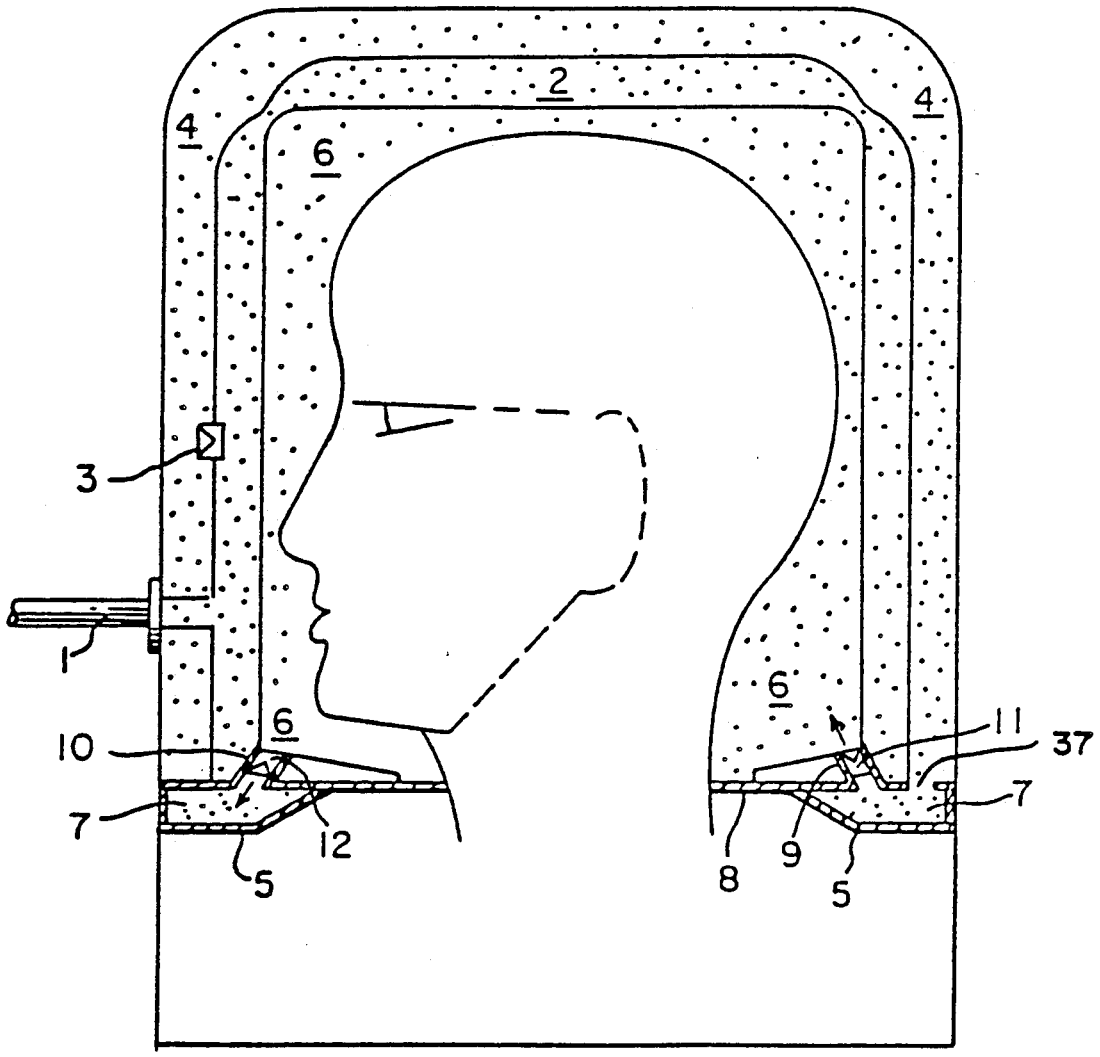
FIG. 1 is a cross-sectional view of a breathing device of the present invention having a $CO_2$ removal means in a circumferential configuration surrounding the neck of the wearer.

The present invention provides a breathing device having concentric inner and outer chambers. The outer chamber is inflatable to a rigidity sufficient to maintain a substantially constant volume of the inner chamber while the wearer is breathing. The device also includes a reservoir connected to the inner chamber by way of a carbon dioxide removal means.

A wide variety of materials can be used for $CO_2$ removal. These include, for example, alkali metal hydroxides and oxides and sodium carbonate. Of these, the lithium and sodium salts are preferred, and lithium hydroxide in particulate form is particularly preferred. In addition, $CO_2$ absorbants in liquid or gel form can be used. The quantity of $CO_2$ absorbant used will vary according to the absorbant selected and the capacity of the hood. In general, about from 50 to 500 grams can be used in the present invention. It has been shown that about from 3 to 4 grams of lithium hydroxide are required for removal of carbon dioxide during each minute of closed circuit breathing in an environment of substantially pure oxygen. Preferably, about from 75 to 150 grams of $CO_2$ absorbant are used in the present devices.

The $CO_2$ removal means can be integrated into the present breathing device in a wide variety of configurations. The $CO_2$ removal means can be contained in a separate chamber positioned, for example, as a ring around the neck of the wearer. In another embodiment, the $CO_2$ removal means can be exterior to the remainder of the hood structure, for example, in a compartment or canister adjacent to the inlet.

In accordance with a preferred embodiment of the present invention, a breathing device is provided which consists of three concentric chambers, the chambers being designated as an inner chamber, an inflatable outer chamber and a reservoir. The inner chamber is nested within and defined by the inflatable chamber which is nested with the reservoir. In the operation of the breathing device, gas is passed from an outside source, such as the fresh air and/or oxygen supply on an aircraft, to the inflatable outer chamber of the breathing device. The reservoir is inflatable to a rigidity sufficient to maintain substantially constant volume of the inner chamber within the breathing device while the wearer is breathing.

If necessary, the neck seal on the hood can provide for release of any excess pressure that may build up in the apparatus from continuing introduction of fresh air or oxygen. However, pressure buildup will normally be prevented by the inlet valve or the one-way valve between the outer chamber and the reservoir, since neither would function with excessive internal pressure.

A valved mechanism is provided to permit passage of the gas, whether fresh air, oxygen enriched air, or pure oxygen, from the outer chamber to the reservoir. A passage is also provided from the reservoir, through a $CO_2$ removal means, to the inner chamber. Accordingly, with the breathing of the wearer, oxygen and/or air is drawn only from the reservoir. In this manner, the inflatable outer chamber is kept at substantially constant volume while the wearer is breathing.

In the breathing cycle, inhalation by the wearer draws air from the reservoir, through the $CO_2$ removal means, and into the inner chamber. The exhaling pressure of the wearer forces exhaust air through the carbon dioxide absorber, and back to the reservoir.

The invention can be more clearly understood by reference to the drawings, in which like numbers are used for like elements in the figures.

In FIG. 1, gas is supplied through inlet 1, from a source, not shown, of fresh air, oxygen, or both, to inflatable outer chamber 2, surrounding the head of the wearer. The inlet is provided with a valve, not shown, to seal the inlet upon disconnection from the source of fresh air or oxygen. When the inflatable outer chamber is substantially fully inflated, the pressure relief valve 3 will permit the gas to flow into reservoir 4, here shown as an additional outer concentric chamber.

The inlet valve and that between the inflatable outer chamber and the reservoir can be conventional valves adjusted to a relief pressure appropriate to the pressures of the oxygen or air supply system as well as the structural integrity of the chamber 2. For the pressure normally encountered in an aircraft environment, a release pressure on the valve of up to about five pounds can be used.

Inhaling of the wearer causes flow from the reservoir through passageway 37 through $CO_2$ removal means 5 to inner chamber 6. Exhaling by the wearer causes passage of exhaust breath back through the $CO_2$ removal means and to the reservoir. The $CO_2$ removal means is here illustrated as an annular ring, containing $CO_2$ absorbant 7, through which the air is circulated in its passage between the reservoir and the inner chamber. Neck seal 8 is provided to fit around the neck of the wearer. This seal is conveniently prepared from a silicon rubber having a thickness of about from 10–15 mils. A central, circular hole having a diameter of about three inches has been found to be useful for most head sizes.

Passageways 9 and 10 connect the inner chamber, through the $CO_2$ removal means, to the reservoir. The passageways can optionally be equipped with one-way valves to facilitate the more complete contact of the air with the $CO_2$ removal means. For example, passageway 9 can have a one-way valve 11, adjusted to open the passageway when a negative pressure is present resulting from the inhaling of the wearer. Similarly, passageway 10 can have a one-way valve 12, adjusted to close under the same conditions. Optionally and preferably the $CO_2$ removal means comprises one or more filter elements or membranes to retain particulate $CO_2$ absorbant.

Figure 1A:
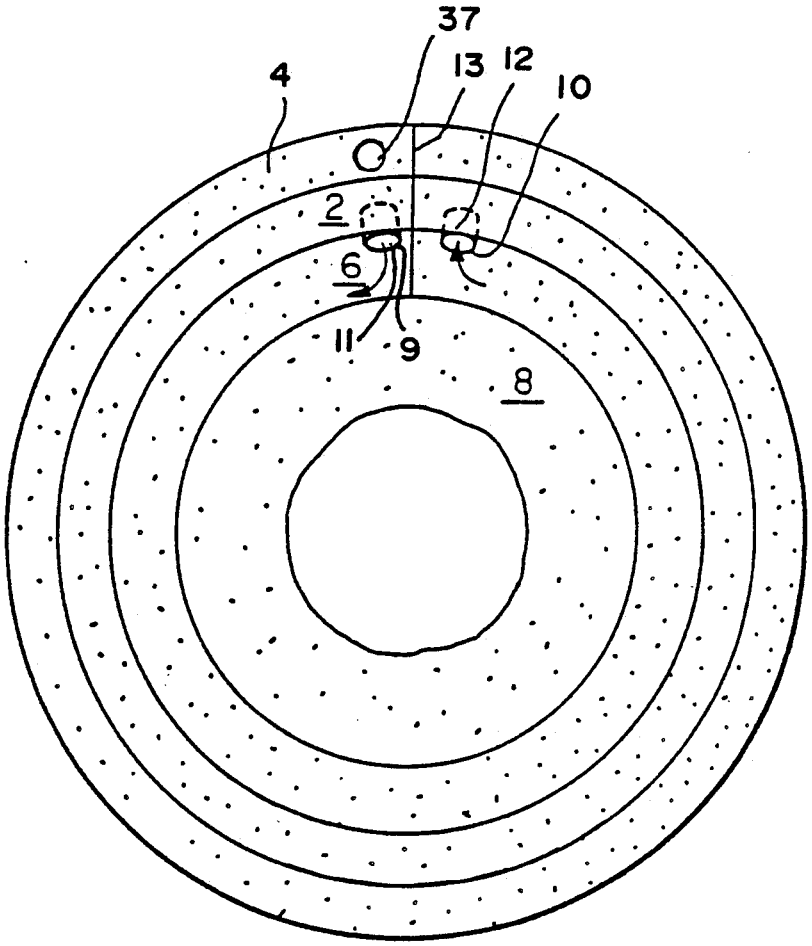
FIG. 1A is a cross-sectional top plan view of another embodiment of the invention, showing an alternative arrangement of the passageways between the chambers.

In still another embodiment of the invention, the annular ring of $CO_2$ absorbant can have both passageways located at the same end of the ring, as shown in FIG. 1A. There, the $CO_2$ absorption means includes a septum 13 which separates passageways 9 and 10 so that the air passes through substantially the entire absorption means in the course of the flow between the inner chamber and the reservoir.

Figure 2:
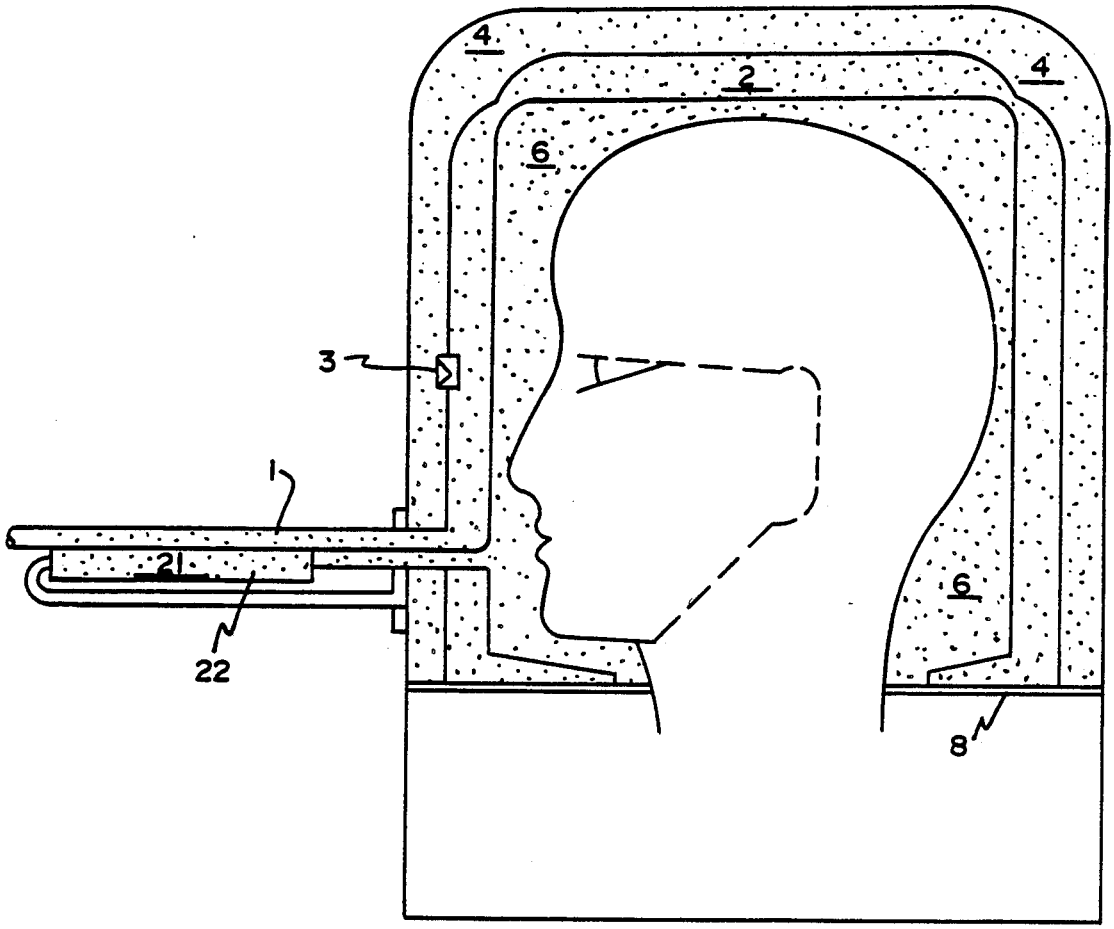
FIG. 2 is a cross-sectional view of a breathing device of a present invention wherein the $CO_2$ removal means is positioned adjacent to the gas inlet.

Another embodiment of the invention is illustrated in FIG. 2, in which the $CO_2$ removal means is exterior to the inner, outer and reservoir elements surrounding the head of the wearer, and is in the form of canister 21 containing $CO_2$ absorbant 22.

Figure 3:
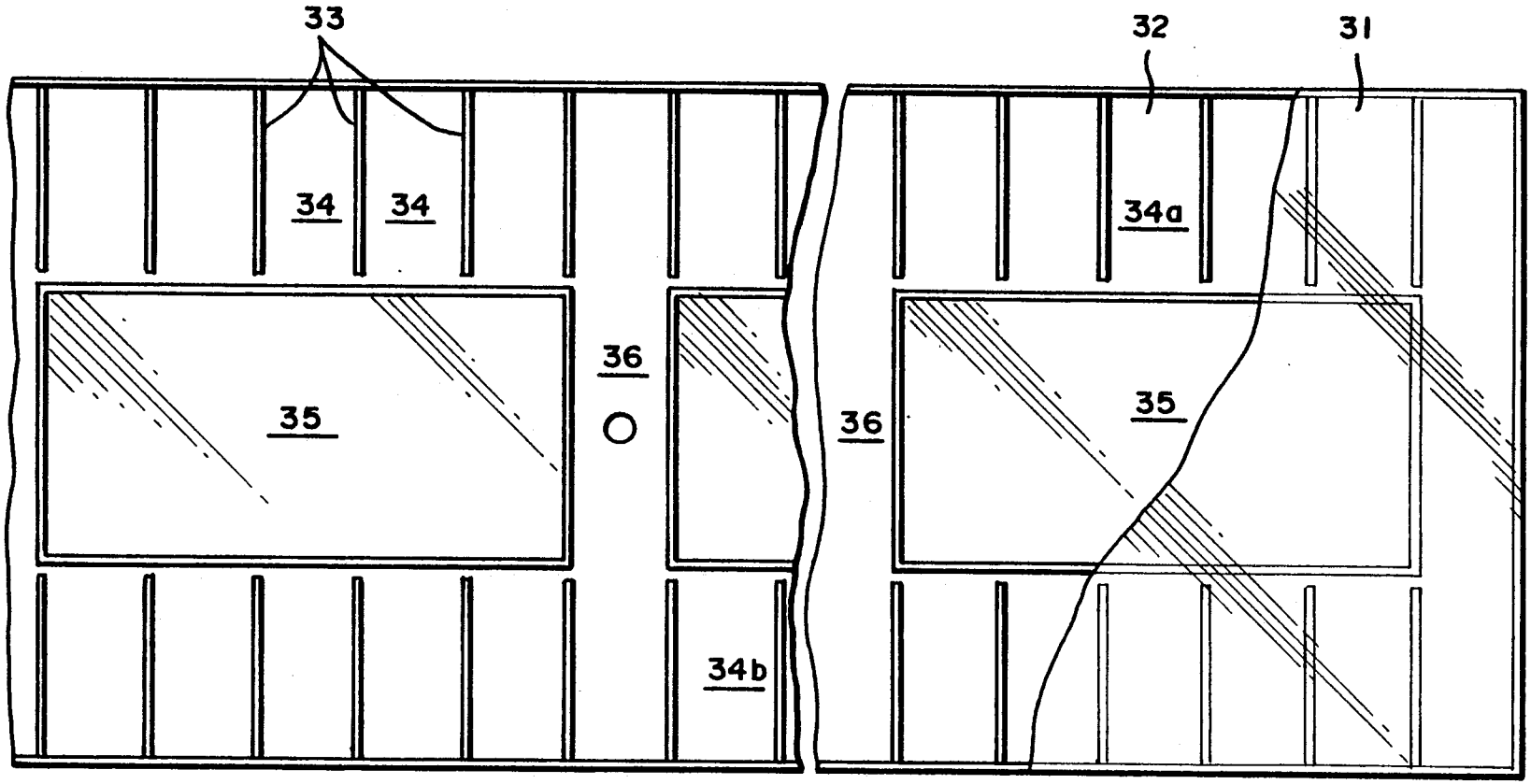
FIG. 3 is a planar view of the details of construction that can be used for the inflatable outer chamber of the present devices.

The outer chamber is inflatable to a rigidity sufficient to maintain substantially constant internal volume while the wearer is breathing. A typical construction which can be used for this function is illustrated in FIG. 3, in which the chamber is fabricated from two layers of thermoplastic material 31 and 32, the two layers being heat sealed at seams 33 to provide a plurality of pockets 34 having upper and lower portions 34A and 34B. Alternatively, the sheets can be adhesively bonded as required. The area between the upper and lower portions is sealed together to provide visibility band 35. The visibility band is interrupted by full length air pockets 36 which increase the rigidity of the structure when inflated.

The outer, inflatable chamber defines the inner chamber of the present apparatus. The reservoir can be prepared from the same or different materials as the inflatable outer chamber, using known techniques for hood construction, as shown, for example, in Werjefelt, U.S. Pat. No. 4,627,431, hereby incorporated by reference. The reservoir and the inflatable outer chamber, together with the $CO_2$ removal means, can be assembled using heat sealing or adhesive means, depending on the component characteristics.

A wide variety of construction materials can be used for the breathing devices of the present invention. Particularly satisfactory are polymeric films, such as polyethylene, polypropylene, polyvinyl chloride, polyurethane, fluoropolymers and polyethylene terephthalate. Such films are particularly useful in forming the inflatable outer chamber. Heat resistant materials such as polyimide films are preferably used for the exterior wall of the breathing device. Those films commerically available from E. I. du Pont de Nemours and Company as Kapton polyimide films have been found to be particularly satisfactory. The exterior surface of the breathing device can be metalized for further heat reflectivity, using techniques well known in the art.

The breathing devices of the present invention provide several advantages over similar devices previously known in the art. The present devices permit, through the inflatable outer chamber, a constant volume while the wearer is breathing, thereby facilitating the flow of gases through the $CO_2$ absorption means by pressure provided by the lungs of the wearer. Moreover, with the carbon dioxide removal means integrated into the breathing device, upon disconnecting the device from the gas supply, maximum utilization of the oxygen in the gas contained within the hood can be obtained. Without the $CO_2$ removal means, the available oxygen can be utilized to a substantially lesser extent, with increasing build-up of carbon dioxide.

The breathing devices of the present invention can be used in a wide variety of applications, including aircraft cabin interiors. When used in conjunction with a gas source, such as those available on an aircraft, the user can breathe in a toxic fume environment or in a decomposition situation for virtually unlimited periods of time. Upon disconnection from a gas source, up to about 45 minutes of breathable and usable air, with the carbon dioxide removal means, are available.

I claim:

1. A breathing device, comprising:

(a) an inner chamber being of sufficient volume so as to be adapted to enclose the head of a wearer and having a neck seal near the bottom thereof adapted to fit around the neck of the wearer;

(b) an inflatable outer chamber concentric with and surrounding said inner chamber, said outer chamber having interior and exterior walls, said inner chamber being defined by said interior wall of said inflatable outer chamber;

(c) a gas reservoir;

(d) a carbon dioxide removal means;

(e) a gas inlet adapted for connection to a source of gas, leading to said outer chamber and a one-way valve means positioned in said exterior wall of said outer chamber, said valve means communicating with said reservoir and said outer chamber for permitting gas to flow from said outer chamber to said reservoir;

(f) a passageway connected to said reservoir, said carbon dioxide removal means and said inner chamber for permitting gas to flow between said reservoir and said inner chamber through said carbon dioxide removal means; and (g) said one-way valve means remaining closed until said outer chamber is inflated to a rigidity adapted to enclose the head of the wearer and sufficient to maintain substantially constant volume of said inner chamber while the wearer is breathing.

2. A breathing device of claim 1, wherein:

(a) said passageway includes a hollow ring attached to the bottom of said device and adapted to surround the neck of the wearer and conduits connecting the interior of said ring to said reservoir and inner chamber; and (b) said carbon dioxide removal means is disposed within said ring.

3. A breathing device of claim 1, wherein:

(a) said passageway includes a container exterior to said outer chamber and conduits connecting said container to said reservoir and said inner chamber; and (b) said carbon dioxide removal means is disposed inside said container.

4. A breathing device of claim 1 comprising about from 50 to 500 grams of $CO_2$ removal means and wherein the $CO_2$ removal means is selected from alkalai metal hydroxides and oxides and sodium carbonate.

5. A breathing device of claim 4 wherein the $CO_2$ removal means consists essentially of lithium hydroxide.

6. A breathing device of claim 4 comprising about from 75–150 grams of particulate $CO_2$ removal means.

7. A breathing device of claim 1 wherein the reservoir comprises a chamber concentric with and exterior to the inflatable outer chamber.

* * * * *